US008807791B2

(12) United States Patent
Huang et al.

(10) Patent No.: US 8,807,791 B2
(45) Date of Patent: Aug. 19, 2014

(54) ILLUMINATING DEVICE WITH ADJUSTABLE LIGHT BEAMS AND METHOD FOR ASSEMBLING THE SAME

(75) Inventors: Chun-Ru Huang, Taipei (TW); Chien-Yueh Chen, Taipei (TW)

(73) Assignee: Av Tech Corp., New Taipei (TW)

( * ) Notice: Subject to any disclaimer, the term of this patent is extended or adjusted under 35 U.S.C. 154(b) by 198 days.

(21) Appl. No.: 13/452,065

(22) Filed: Apr. 20, 2012

(65) Prior Publication Data

US 2013/0208466 A1 Aug. 15, 2013

(30) Foreign Application Priority Data

Feb. 14, 2012 (TW) ..... 101104805 A

(51) Int. Cl.
*F21V 1/00* (2006.01)

(52) U.S. Cl.
USPC . 362/235; 362/217.05; 362/227; 362/249.01; 362/509

(58) Field of Classification Search
USPC ..... 362/217.01, 217.02, 217.05, 227, 234, 362/235, 249.01, 249.02, 249.14, 296.01, 362/326, 341, 509, 516, 520, 543–545
See application file for complete search history.

(56) References Cited

U.S. PATENT DOCUMENTS

2010/0123600 A1* 5/2010 Mayer et al. ..... 340/907
2010/0188301 A1* 7/2010 Kishimoto et al. ..... 343/721

* cited by examiner

*Primary Examiner* — Meghan Dunwiddie
(74) *Attorney, Agent, or Firm* — Wang Law Firm, Inc.; Li K. Wang; Stephen Hsu

(57) ABSTRACT

An illuminating device with adjustable light beams and a method for assembling the same. The light-emitting units are disposed on the substrate. The optical element is disposed in the path of a light emitted by at least one of the light-emitting units. The driving unit drives a first or second set of the light-emitting units, wherein a light beam formed by light that is emitted by the first set of the light-emitting units and passes through the optical element has a different shape or projection angle from a light beam formed by light that is emitted by the second set of the light-emitting units and passes through the optical element.

18 Claims, 7 Drawing Sheets

ILLUMINATING DEVICE WITH ADJUSTABLE LIGHT BEAMS AND METHOD FOR ASSEMBLING THE SAME

CROSS-REFERENCE TO RELATED APPLICATION

This application claims the benefit of Taiwan Patent Application No. 101104805, filed on Feb. 14, 2012, in the Taiwan Intellectual Property Office, the disclosure of which is incorporated herein in its entirety by reference.

BACKGROUND OF THE DISCLOSURE

1. Field of the Invention

The present invention relates to an illuminating device, and more particularly, to an illuminating device with adjustable light beams, wherein the illuminating device is provided with variable lights and thereby forms light beams in adjustable shapes or projection angles, and a method for assembling the same.

2. Description of the Related Art

Under encountering the scarcity of resources on the earth, energy saving technology is widely developed. Light-emitting diodes acting as light sources have high efficiency, long life spans, difficult to damage and low energy consumption and thus become one of the recent hot topics. Accordingly, the light-emitting diodes have been widely applied to illuminating devices, indicator lights of electric apparatuses, traffic lights, back light sources and so on.

However, the light-emitting diode or illuminating unit of prior art projects light in a fixed angle at shipment, and the angle cannot be changed after delivery. For adjusting the angles, a mechanically movable lens can be set in front of the light-emitting diode, but its manufacturing process steps are increased with inconvenience.

Therefore, it is a demand to overcome the illuminating unit of prior art projecting light only in a fixed angle, to overcome the mechanically movable optical element of prior art set for controlling projection angles, and to provide an improved illuminating device forming light beams in adjustable shapes, projection angles and intensities by electronically controlling illuminating units in specific regions to sequentially or randomly emit light passing through an optical element.

SUMMARY OF THE INVENTION

In order to improve the above-mentioned problems of prior art, the present invention is directed to an illuminating device with adjustable light beams, wherein the illuminating device has light-emitting units selected to emit light and thereby forms light beams in adjustable shapes or projection angles.

The present invention proposes an illuminating device with adjustable light beams. The illuminating device comprises a substrate, multiple light-emitting units, an optical element and a driving unit. The light-emitting units are disposed on the substrate. The optical element is disposed in the path of a light emitted by at least one of the light-emitting units. The driving unit drives a first or second set of the light-emitting units, wherein a light beam formed by light that is emitted by the first set of the light-emitting units and passes through the optical element has a different shape or projection angle from a light beam formed by light that is emitted by the second set of the light-emitting units and passes through the optical element.

In one embodiment, the light-emitting units disposed on the substrate are arranged in multiple rings.

In one embodiment, the light-emitting units arranged in the innermost one of the rings are defined as the first set thereof, and project light in an angle less than a preset angle.

In one embodiment, the light-emitting units arranged in the outermost one of the rings are defined as the second set thereof, and project light in an angle greater than a preset angle.

In one embodiment, the light-emitting units disposed on the substrate are arranged in a rectangle.

In one embodiment, the light beam formed by the light that is emitted by the first set of the light-emitting units and passes through the optical element has a different intensity from the light beam formed by the light that is emitted by the second set of the light-emitting units and passes through the optical element.

In one embodiment, the optical element has an optical surface containing a sphere or not containing a sphere, a Fresnel optical surface or a microstructured optical surface.

In one embodiment, the optical element comprises a lens, a reflector or a refraction plate.

In one embodiment, the reflector comprises a parabolic reflector, an elliptical reflector or a hyperboloid reflector.

In one embodiment, the refraction plate has a teeth shape, a trapezoidal shape, a pillar shape or a globe shape.

The present invention proposes a method for assembling an illuminating device. The method comprises the following steps: providing a substrate; disposing multiple light-emitting units on the substrate; disposing an optical element in the path of a light emitted by at least one of the light-emitting units; and selectively driving a first or second set of the light-emitting units using a driving unit, wherein a light beam formed by light that is emitted by the first set of the light-emitting units and passes through the optical element has a different shape or projection angle from a light beam formed by light that is emitted by the second set of the light-emitting units and passes through the optical element.

In accordance with the present invention, the illuminating device with adjustable light beams and the method for assembling the same have the following advantages:

(1) In accordance with the present invention, the illuminating device with adjustable light beams and the method for assembling the same overcome the illuminating unit of prior art projecting light only in a fixed angle.

(2) In accordance with the present invention, the illuminating device with adjustable light beams and the method for assembling the same overcome the mechanically movable optical element of prior art set for controlling projection angles.

(3) In accordance with the present invention, the illuminating device with adjustable light beams and the method for assembling the same form light beams in adjustable projection angles by electronically controlling illuminating units in specific regions to sequentially or randomly emit light passing through an optical element.

The accompanying drawings are included to provide a further understanding of the invention, and are incorporated as a part of this specification. The drawings illustrate embodiments of the invention and, together with the description, serve to explain the principles of the invention.

DETAILED DESCRIPTION OF THE PREFERRED EMBODIMENTS

Illustrative embodiments accompanying with figures are now described below to lead the characteristics, contents, advantages and effects of the invention to be understood by the Examiner. Figures are illustrated only for explanation, but are not drawn to scale and precise arrangement, and thus the scope of the invention should not be limited by the scale and arrangement illustrated in the figures.

The following illustrations with accompanying figures are embodiments for describing an illuminating device with adjustable light beams and a method for assembling the same. In the following embodiments, same elements are indicated by same reference numbers.

Figure 1:
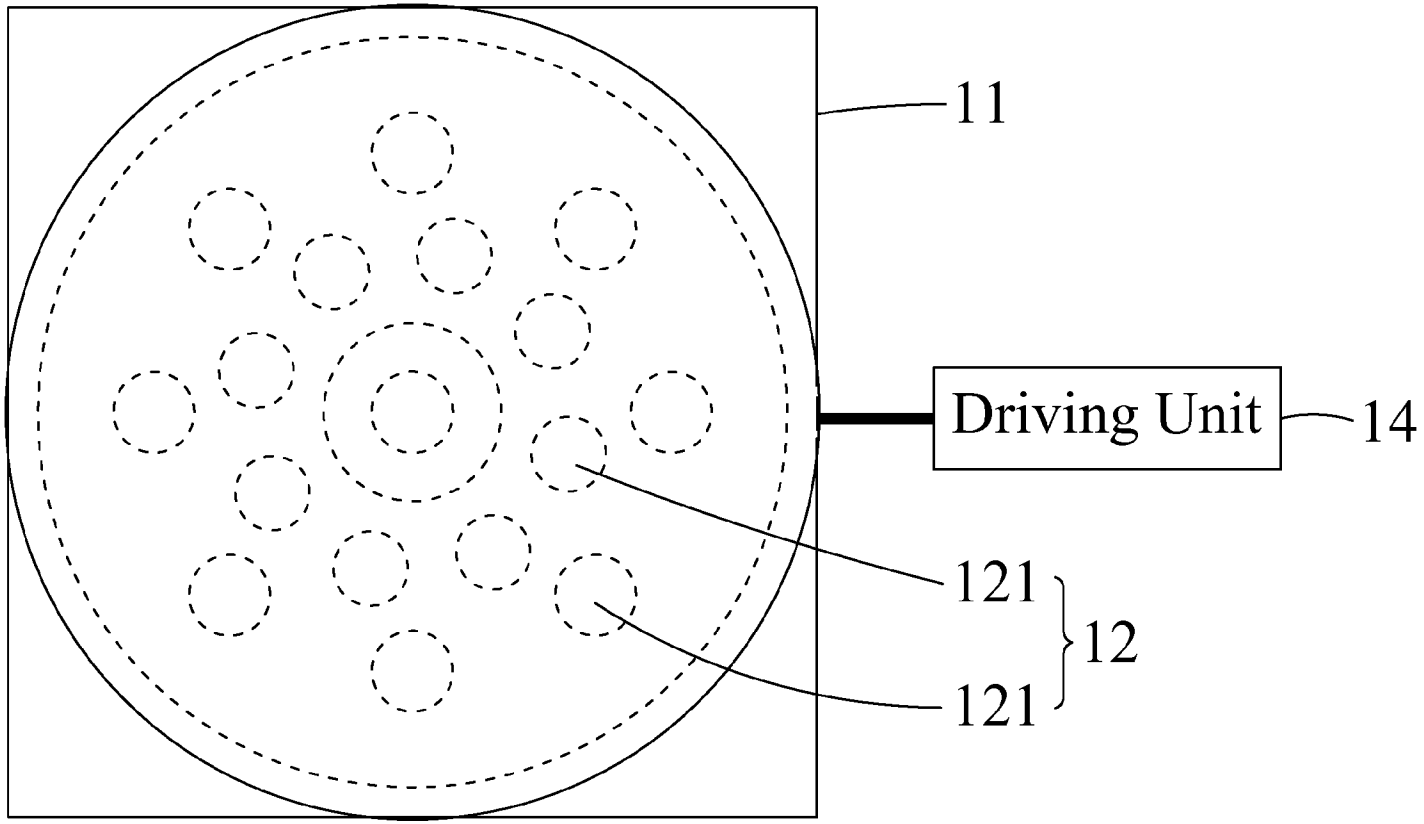
FIG. 1 is a first schematic view of an illuminating device in accordance with a first embodiment of the present invention.
Figure 2:
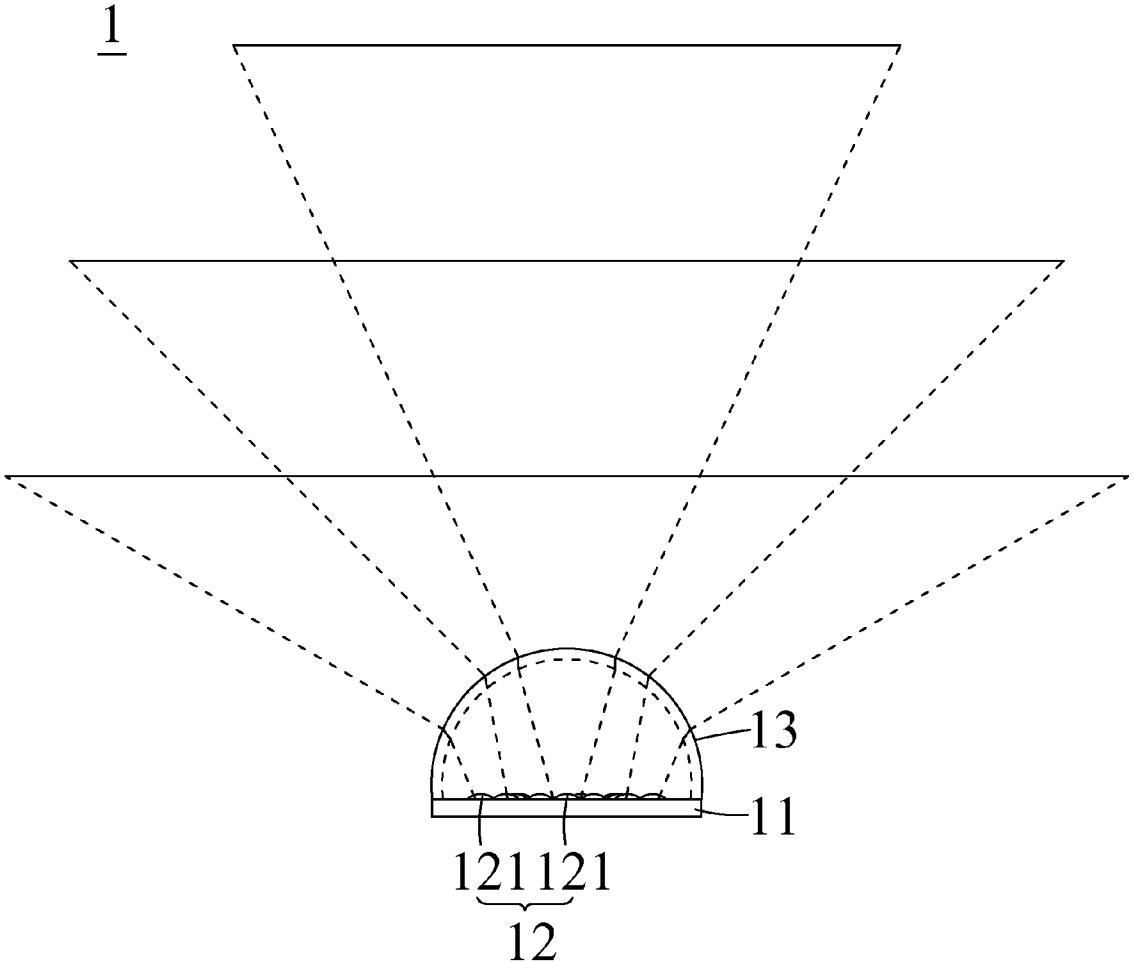
FIG. 2 is a second schematic view of an illuminating device in accordance with a first embodiment of the present invention.
Figure 3:
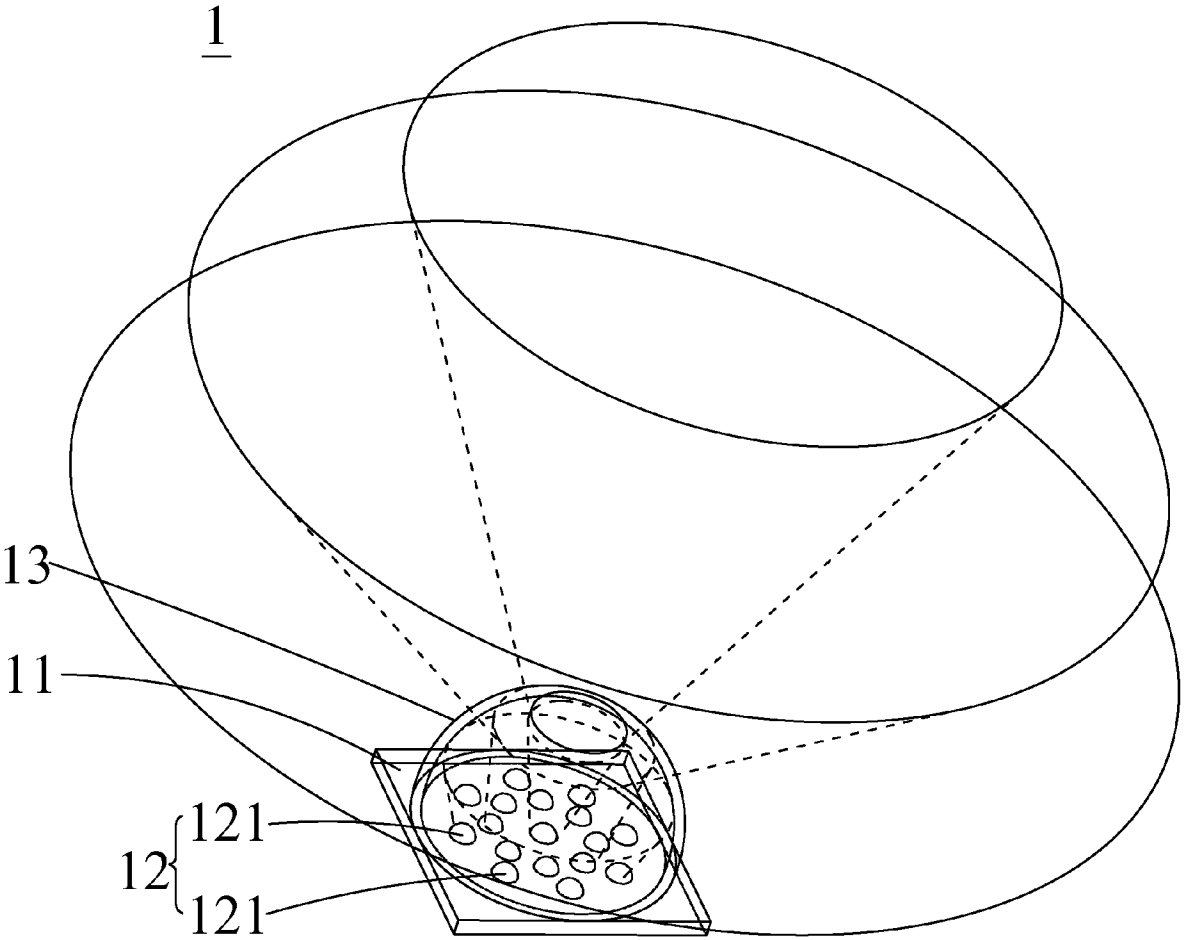
FIG. 3 is a third schematic view of an illuminating device in accordance with a first embodiment of the present invention.

FIGS. 1, 2 and 3 are first, second and third schematic views of an illuminating device in accordance with a first embodiment of the present invention. Referring to FIGS. 1, 2 and 3, multiple illuminating units 12 can be incandescent lamps, light-emitting diodes (LED) or high intensity discharge (HID) lamps. In accordance with this embodiment, the illuminating units 12 are multiple light-emitting diodes. Referring to FIG. 1, the light-emitting diodes 121 are disposed on a substrate 11 in a specific pattern, like arrangement in one or more rings in this embodiment, wherein the arrangement and number of the rings are not limited in this way, wherein the light-emitting diodes 121 are electrically connected to the substrate 11. The light-emitting diodes 121 arranged in the innermost one of the rings are defined as a first set of the illuminating units 12. The light-emitting diodes 121 arranged close to the innermost one of the rings are defined as a second set of the illuminating units 12. The light-emitting diodes 121 arranged in the outermost one of the rings are defined as a third set of the illuminating units 12. A driving unit 14 selectively drives the first or second set of the light-emitting units 12 to emit light in specific patterns.

Referring to FIG. 2, an optical element 13 can be disposed over the substrate 11 and the illuminating units 12. The optical element 13 has a distance to the substrate 11 or each illuminating units 12, designed based on demand, and is set in the path of a light emitted by at least one of the light-emitting diodes 121. The distance shown in Figures is an example, not drawn to scale, and thus should not be interpreted based on a proportion in Figures and limited to the scope of the invention. The optical element 13 can be a lens, reflector or refraction plate. In the embodiment, the optical element 13 is a lens. With regards to the reflector, it can be a parabolic reflector, elliptical reflector or hyperboloid reflector. With regards to the refraction plate, it may have a teeth shape, trapezoidal shape, pillar shape or globe shape.

Referring to FIGS. 1 and 3, under controlling the illuminating units 12 by the driving unit 14, the light-emitting diodes 121 in different regions can be sequentially or randomly selected to emit light in different fixed angles or scopes. For example, the first set of the light-emitting diodes 121 driven by the driving unit 14 can emit light in an angle of 30 degrees, that is, in the smallest scope. The third set of the light-emitting diodes 121 driven by the driving unit 14 can emit light in an angle of 45 degrees, that is, in the largest scope. However, light emitted in a fixed angle has a limited illumination scope, and thus has a restricted application. The optical element 13 is set over the illuminating units 12 and the substrate 11. Thereby, light emitted by the illuminating units 12 can pass through the optical element 13 refracting the light, and then light beams can be emitted in different angles.

Referring to FIG. 3, light emitted in an angle of 30 degrees by the first set of the light-emitting diodes 121 arranged in the innermost ring passes through the optical element 13, and then refracts in a projection angle of 50 degrees to form a circle light beam. Light emitted in an angle of 20 degrees by the second set of the light-emitting diodes 121 arranged in the second ring passes through the optical element 13, and then refracts in a projection angle of 90 degrees to form another circle light beam. Light emitted in an angle of 45 degrees by the third set of the light-emitting diodes 121 arranged in the outermost ring passes through the optical element 13, and then refracts in a projection angle of 120 degrees to form the other circle light beam. The light beams have refraction angles that vary with the material of the optical element 13. The light-emitting diodes 121 and the sets thereof can be alternatively arranged based on demand, and the driving unit 14 drives the selected set of the light-emitting units 12 individually to emit lights such that the lights passing through the optical element 13 can form different light beams having different shapes or projection angles.

In reference to the first embodiment, a second embodiment is alternatively proposed as below.

Figure 4:
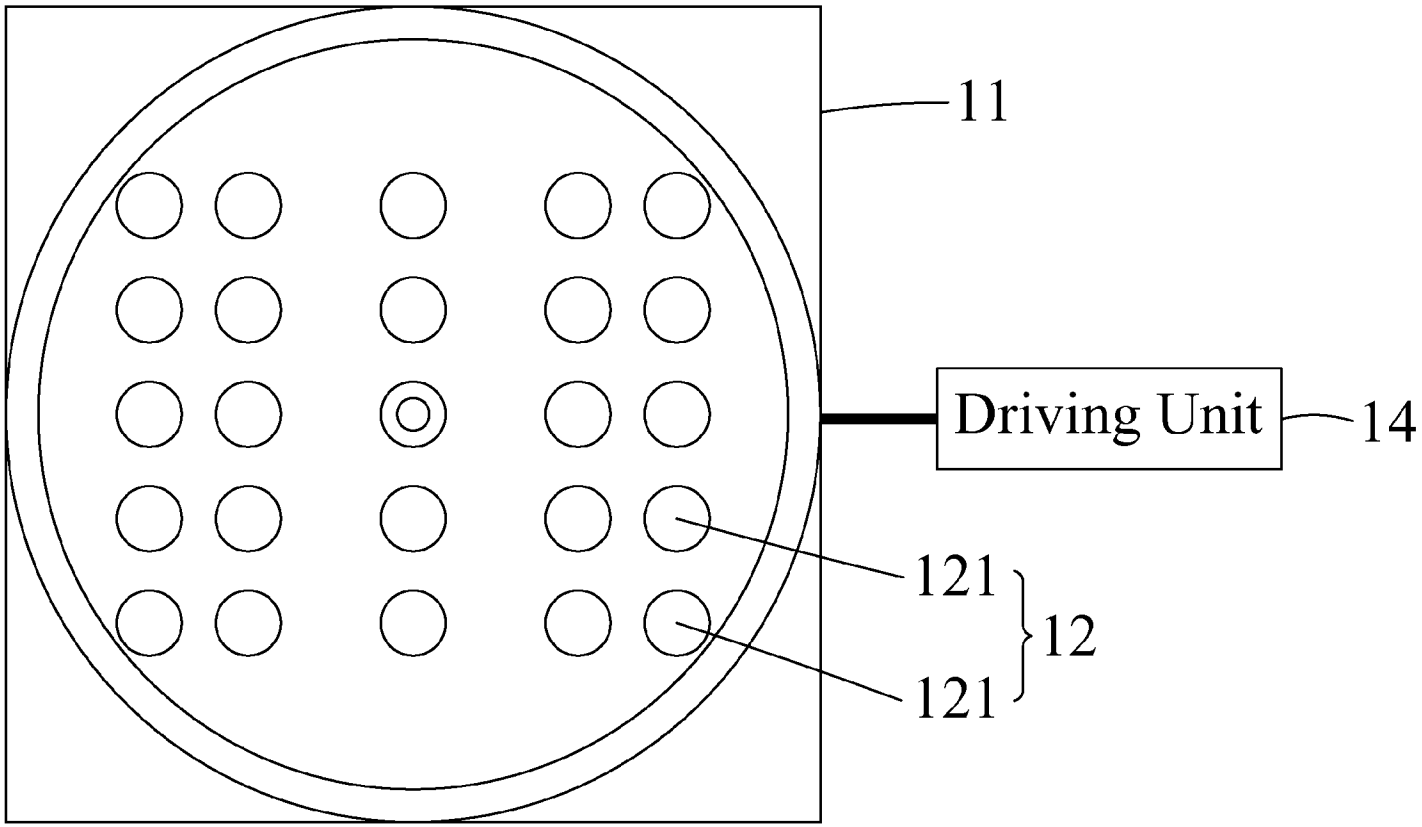
FIG. 4 is a first schematic view of an illuminating device in accordance with a second embodiment of the present invention.
Figure 5:
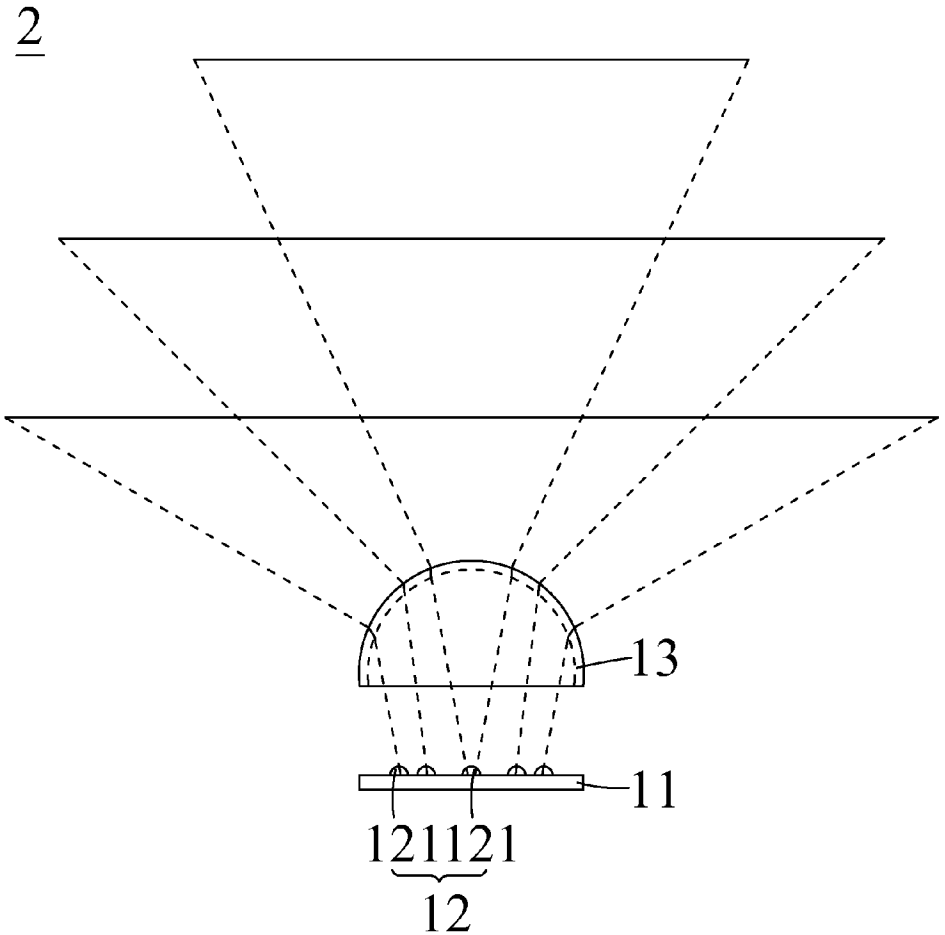
FIG. 5 is a second schematic view of an illuminating device in accordance with a second embodiment of the present invention.
Figure 6:
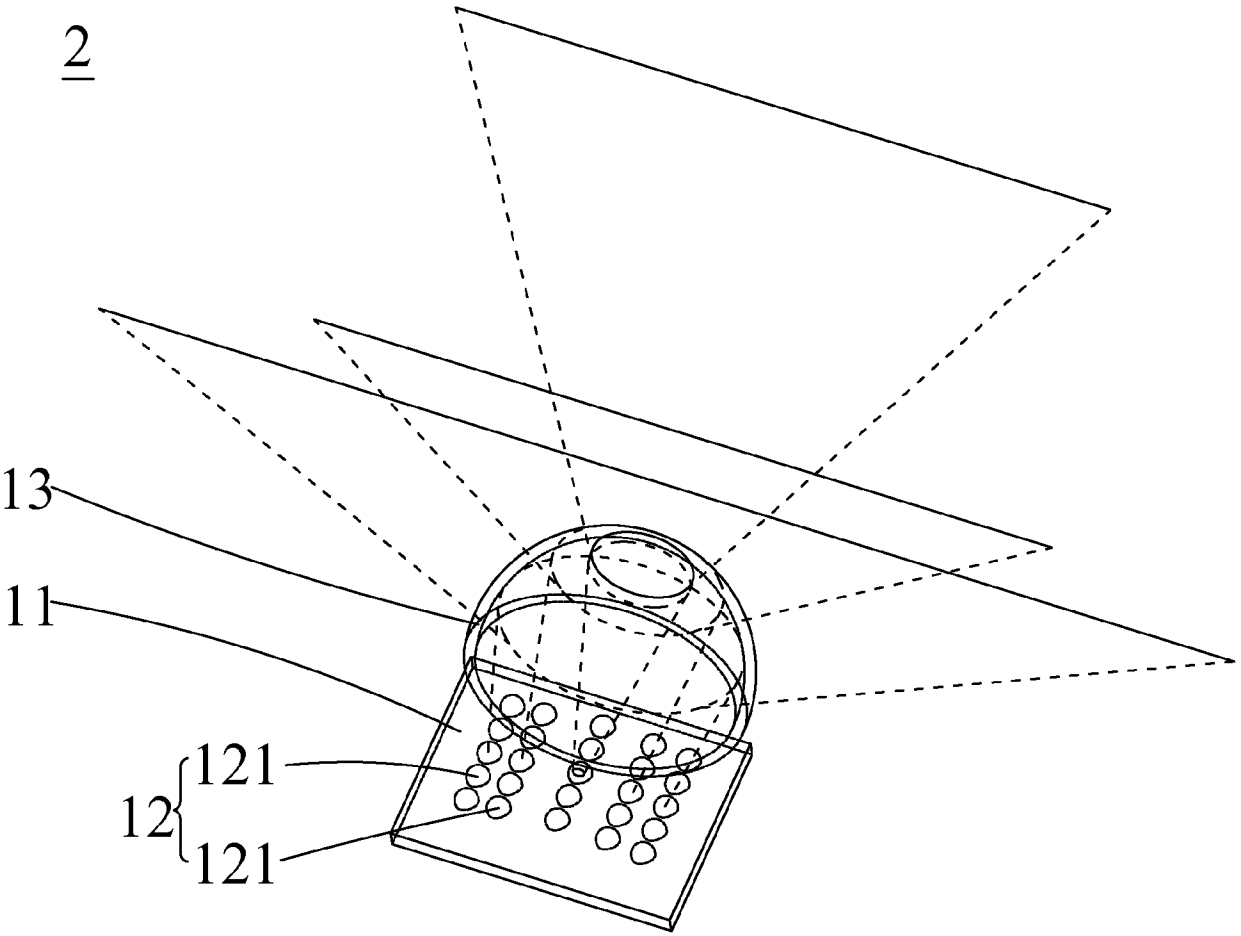
FIG. 6 is a third schematic view of an illuminating device in accordance with a second embodiment of the present invention.

FIGS. 4, 5 and 6 are first, second and third schematic views of an illuminating device in accordance with a second embodiment of the present invention. Referring to FIGS. 4, 5 and 6, multiple illuminating units 12 can be incandescent lamps, light-emitting diodes (LED) or high intensity discharge (HID) lamps. In accordance with this embodiment, the illuminating units 12 are multiple light-emitting diodes. Referring to FIG. 4, the light-emitting diodes 121 are disposed on a substrate 11 in a specific pattern, like arrangement in a rectangle in this embodiment, wherein the arrangement and number of the rings are not limited in this way, wherein the light-emitting diodes 121 are electrically connected to the substrate 11. The optical element 13 has a distance to the substrate 11 or each illuminating units 12, wherein the distance shown in Figures is an example and should not limited the scope of the present invention. The optical element 13 is set in the path of a light emitted by at least one of the light-emitting units 12. The optical element 13 has an optical surface containing a sphere or not containing a sphere, Fresnel optical surface or a microstructured optical surface. The optical element 13 can be a lens, reflector or refraction plate. In the embodiment, the optical element 13 is a lens. The driving unit 14 drives the illuminating units 12 such that the light-emitting diodes 121 can be electrically controlled in sequence or random to emit light in fixed angles or scopes.

Referring to FIG. 5, under controlling the illuminating units 12 by the driving unit 14, the light-emitting diodes 121 in different regions can be sequentially or randomly selected to emit light in different fixed angles. The optical element 13 is set over the illuminating units 12 and the substrate 11. Thereby, light emitted by the illuminating units 12 can pass through the optical element 13 refracting the light, and then light beams can be emitted in different projection angles.

For example, referring to FIG. 6, in the 25 light emitting diodes 121 arranged in a rectangle, the third one from the right side in the third row is defined as a first set, the second one from the right side in the third row and the second one from the left side in the third row are defined as a second set, and the first one from the right side in the third row and the first one from the left side in the third row are defined as a third set. As shown in Figures, light emitted in an angle of 21 degrees by the first set of the light-emitting diodes 121 arranged at the center in the third row passes through the optical element 13, and then refracts in a projection angle of 50 degrees to form a light beam. Light emitted in an angle of 14 degrees by the second set of the light-emitting diodes 121 passes through the optical element 13, and then refracts in a projection angle of 90 degrees to form a light beam. Light emitted in an angle of 21 degrees by the third set of the light-emitting diodes 121 passes through the optical element 13, and then refracts in a projection angle of 120 degrees to form a light beam. The light beams have refraction angles that vary with the material of the optical element 13. The sets of the light-emitting diodes 121 of the illuminating device 2 may have alternative positions based on demand. As shown in Figures, light emitted by the first, second and third sets of the light-emitting diodes 121 passes through the optical element 13 so as to form variable light beams each in the shape of a knife edge.

Besides, the intensity of light emitted by the illuminating units 12 can be adjusted by electrically controlling currents output from the driving unit 14. Thereby, the illuminating units 12 can be designed with multiple scenarios including relatively bright or dark ones arranged in the center, relatively bright or dark ones arranged in the outer side and uniform bright ones arranged in the center and outer side. For example, a wide-angle camera has a wide angle of view, but serious image distortion and dark corners could occur. The dark corners can be corrected using the driving unit 14 of the present invention to control light emitted by the illuminating units 12.

Figure 7:
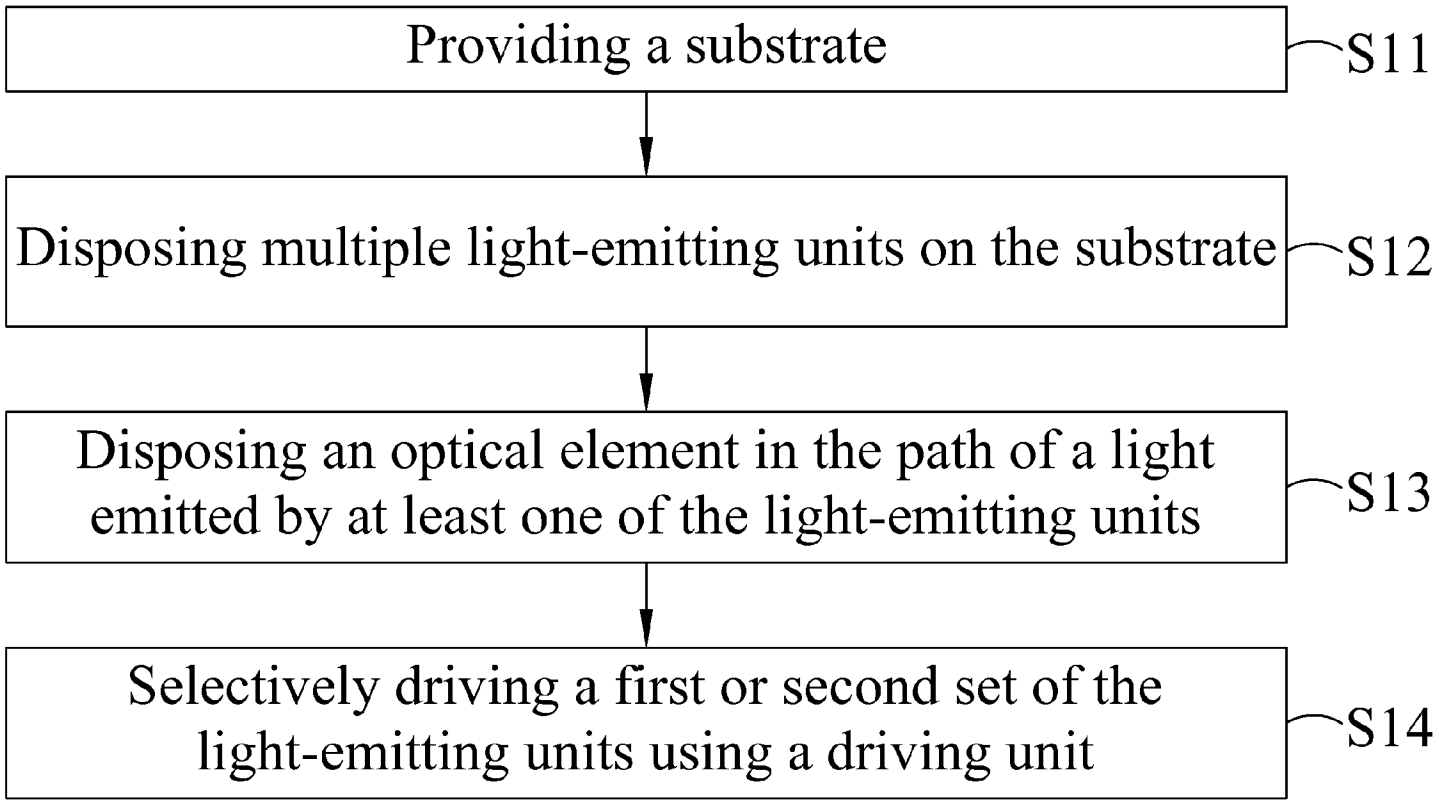
FIG. 7 is a flow chart of assembling an illuminating device in accordance with the present invention.

For clarity, the method for assembling the illuminating device in accordance with the present invention are interpreted as below:

FIG. 7 is a flow chart of assembling an illuminating device in accordance with the present invention. Referring to FIG. 7, a method for assembling the illuminating device includes the following steps:

Step S11 is providing a substrate.

Step S12 is disposing multiple light-emitting units on the substrate.

Step S13 is disposing an optical element in the path of a light emitted by at least one of the light-emitting units.

Step S14 is selectively driving a first or second set of the light-emitting units using a driving unit.

It is noted that a light beam formed by light that is emitted by the first set of the light-emitting units and passes through the optical element has a different shape or projection angle from a light beam formed by light that is emitted by the second set of the light-emitting units and passes through the optical element.

In the above description for the illuminating device, the method for assembling the same is also described and the similar description is not repeated herein.

Illustrative embodiments accompanying with figures are above described but addition, modification or replacement applied to the embodiments of the present invention is within the scope of the claims. The skilled in the art would understand the invention can be realized with modification of multiple structures, arrangements, proportions and elements.

What is claimed is:

1. An illuminating device with adjustable light beams, comprising:

a substrate;

multiple light-emitting units disposed on the substrate;

an optical element disposed in the path of a light emitted by at least one of the light-emitting units; and a driving unit driving a first or second set of the light-emitting units, wherein a light beam formed by light that is emitted by the first set of the light-emitting units and passes through the optical element has a different shape or projection angle from a light beam formed by light that is emitted by the second set of the light-emitting units and passes through the optical element;

wherein the light beam formed by the light that is emitted by the first set of the light-emitting units and passes through the optical element has a different intensity from the light beam formed by the light that is emitted by the second set of the light-emitting units and passes through the optical element.

2. The illuminating device of claim 1, wherein the light-emitting units disposed on the substrate are arranged in multiple rings.

3. The illuminating device of claim 2, wherein the light-emitting units arranged in the innermost one of the rings are defined as the first set thereof and project light in an angle less than a preset angle.

4. The illuminating device of claim 2, wherein the light-emitting units arranged in the outermost one of the rings are defined as the second set thereof and project light in an angle greater than a preset angle.

5. The illuminating device of claim 1, wherein the light-emitting units disposed on the substrate are arranged in a rectangle.

6. The illuminating device of claim 1, wherein the optical element has an optical surface containing a sphere or not containing a sphere, a Fresnel optical surface or a microstructured optical surface.

7. The illuminating device of claim 1, wherein the optical element comprises a lens, reflector or refraction plate.

8. The illuminating device of claim 7, wherein the reflector comprises a parabolic reflector, an elliptical reflector or a hyperboloid reflector.

9. The illuminating device of claim 7, wherein the refraction plate has a teeth shape, a trapezoidal shape, a pillar shape or a globe shape.

10. A method for assembling an illuminating device, comprising:

providing a substrate;

disposing multiple light-emitting units on the substrate;

disposing an optical element in the path of a light emitted by at least one of the light-emitting units; and selectively driving a first or second set of the light-emitting units using a driving unit, wherein a light beam formed by light that is emitted by the first set of the light-emitting units and passes through the optical element has a different shape or projection angle from a light beam formed by light that is emitted by the second set of the light-emitting units and passes through the optical element;

wherein the light beam formed by the light that is emitted by the first set of the light-emitting units and passes through the optical element has a different intensity from the light beam formed by the light that is emitted by the second set of the light-emitting units and passes through the optical element.

11. The method of claim 10, wherein the light-emitting units disposed on the substrate are arranged in multiple rings.

12. The method of claim 11, wherein the light-emitting units arranged in the innermost one of the rings are defined as the first set thereof and project light in an angle less than a preset angle.

13. The method of claim 11, wherein the light-emitting units arranged in the outermost one of the rings are defined as the second set thereof and project light in an angle greater than a preset angle.

14. The method of claim 10, wherein the light-emitting units disposed on the substrate are arranged in a rectangle.

15. The method of claim 10, wherein the optical element has an optical surface containing a sphere or not containing a sphere, a Fresnel optical surface or a microstructured optical surface.

16. The method of claim 10, wherein the optical element comprises a lens, a reflector or a refraction plate.

17. The method of claim 16, wherein the reflector comprises a parabolic reflector, an elliptical reflector or a hyperboloid reflector.

18. The method of claim 16, wherein the refraction plate has a teeth shape, a trapezoidal shape, a pillar shape or a globe shape.

* * * * *